US005769735A

United States Patent [19]

Hosokawa

[11] Patent Number: 5,769,735

[45] Date of Patent: Jun. 23, 1998

[54] METAL WOOD GOLF CLUB HEAD

[75] Inventor: Toshihiro Hosokawa, Izumi, Japan

[73] Assignee: Kabushiki Kaisha Hosokawaseisakusho, Izumi, Japan

[21] Appl. No.: 762,048

[22] Filed: Dec. 9, 1996

Related U.S. Application Data

[63] Continuation of Ser. No. 526,851, Sep. 11, 1995, abandoned.

[51] Int. Cl.[6] ..... A63B 53/04

[52] U.S. Cl. ..... 473/332; 473/346; 473/349

[58] Field of Search ..... 473/324, 325, 473/326, 327, 328, 329, 330, 331, 332, 333, 334, 335, 336, 341, 345, 346, 347, 348, 349, 350, 282

[56] References Cited

U.S. PATENT DOCUMENTS

| | | | |
|---|---|---|---|
| 1,529,009 | 3/1925 | Carpenter | 273/171 |
| 4,145,052 | 3/1979 | Janssen | 273/171 |
| 4,214,754 | 7/1980 | Zebelean . | |
| 4,438,931 | 3/1984 | Motomiya | 273/80.2 |
| 4,824,116 | 4/1989 | Nagamoto | 273/167 H |
| 5,007,643 | 4/1991 | Okumoto | 273/167 H |
| 5,135,227 | 8/1992 | Okumoto | 273/167 H |
| 5,288,070 | 2/1994 | Chen | 273/167 H |
| 5,306,450 | 4/1994 | Okumoto | 273/167 H |
| 5,647,808 | 7/1997 | Hosokawa | 473/342 |

*Primary Examiner*—Sebastiano Passaniti
*Attorney, Agent, or Firm*—Curtis L. Harrington

[57] ABSTRACT

A metal wood club head for golf and a method for producing the metal wood golf club head relating to the present invention can transmit, to his hands through the shaft, the feeling of where on the club face the user hit the ball similar to persimmon heads so that the user can make progress in playing golf, cause little trouble to his elbows because of the decreased vibration at the impact of a shot, have sperior durability and impact resiliency, and are readily suitable for mass-production on the assembly line. The club head comprises a metal outer shell having a hollow inside portion and foamed metal arranged into the hollow inside portion which are united integrally. A main member of the club head may be a foamed metal. Then it is favorable that at least the face plate of the main member is covered with metal. The surface of the main member may be covered with a divided shell member.

6 Claims, 6 Drawing Sheets

METAL WOOD GOLF CLUB HEAD

This is a continuation of application Ser. No. 08/526,851 which parent application was filed on Sep. 11, 1995 now abandoned.

FIELD OF THE INVENTION

This invention relates to a metal wood club head for golf and a method of producing the club head and a method for producing the metal wood club head. Which, through the shaft, can transmit the feeling of a shot similar to persimmon club heads to the user's hands so that the user can improve in playing golf, causes little trouble to the user's elbows because of the soft feel at impact, has superior durability and impact resiliency, and is readily suitable for mass production on the assembly line.

PRIOR ART

Solid club heads formed by cutting natural persimmon wood into required configuration have been generally used as wood club heads for golf.

Golf clubs with persimmon heads have been suitable for the user to make progress in playing golf since the club heads are made of natural wood and are solid so that the user can have a soft feeling at impact and can feel the shot through the shaft, namely the user can readily feel where on the club face he hits the ball.

However, there is a problem that persimmon as a material of golf club heads cannot be mass-produced because persimmon is a natural wood.

In recent years an increasing number of metal wood club heads have been manufactured to replace persimmon club heads. Metal wood club heads comprise a face shell piece, usually formed as a shell, an upper shell piece and a sole shell piece which are respectively produced by casting or press and integrated by welding after mounting a balance weight inside the sole shell piece.

Stainless steel was mostly used as a metal wood head material in the past, however recently titanium or titanium alloy is becoming more commonly used due to its small specific gravity relative to that of other metals, its high strength and sperior impact resiliency.

The capacity for a wood club head is predetermined and a wood golf club with a club head of small capacity can not sufficiently fulfill its function. Although the specific gravity of titanium is small relative to that of other metals, it is from 4 to 5 times greater than that of persimmon wood. Thus club heads should be hollow when they comprise metal matelials such as titanium and so on.

The hollow metal wood club head results in the problem that the user can not feel the shot as if he had used a club with a solid persimmon head. The hollow club heads are not suitable for amateurs since the user can not feel where on the club face he hits the ball, making it difficult for the user to improve his golf game.

Another problem is that users familiar with golf clubs with persimmon heads are unwilling to use wood clubs with metal heads since it offers the user a hard feeling at impact and is difficult to control the curve of the flying line of the ball compared with a club head made of such wood materials as persimmon of shots with a metal wood club and to control the curve of the ball compared with a persimmon head. There is the further problem that the hollow metal wood club head often results in troubles of the elbows because of a strong vibration at impact.

In addition, there is the problem of inefficiency of production because the balance weight is mounted later to keep the balance of the metal wood club head lower.

Therefore the present invention has the objective of providing a metal wood club head for golf and a metal wood golf club with the club head which can transmit through the shaft to the user's hands the feeling of where on the club face the ball was hit similar to persimmon heads so that the user can make progress in playing golf, causes little trouble of his elbows, with superior durability and impact resiliency, and is readily suitable for mass production on the assembly line.

SUMMARY OF THE INVENTION

The present invention relates to a metal wood club head for golf comprising a metal outer shell with a hollow inside portion and foamed metal arranged in the hollow inside portion which are united integrally, and a metal wood golf club with the club head.

The metal outer shell of the metal wood club head having the construction as stated above comprises metal materials so that the standarized club heads can be mass-produced, and the club head is a solid head arranging the foamed metal with spuperior absorptivity at impact which is united integrally with the outer shell so that the club head can transmit through the shaft to the user's hands the feeling of where on the club face the ball was hit similar to persimmon heads to promote the user's progress in playing golf.

With the metal wood club with this club head, the user can also have a soft feeling at impact the curve of the flight line of the ball of shots and control soft feeling at impact the curve of the flight line of the ball so that the users familiar with wood golf clubs with persimmon heads also use the wood club having the club head without reluctance, and its soft impact results in little trouble of the user's elbows.

If metal materials with relatively large specific gravity are used as the outer shell of the club head, capacity as a metal wood club head is sufficiently secured as a solid head since foamed metal with small specific gravity of 0.2–0.3 is light.

The metal wood club head also has high strength and superior durability and impact resiliency because the outer shell of the club head is made of metal.

According to the present invention, a metal wood golf club with a light metal wood club head having superb absorptivity at impact can be produced by forming core foamed metal as a main member of the club head and covering the surface of the main member with divided shell member so that the club head can transmit through the shaft to the user's hands the feeling of where on the club face the ball was hit similar to persimmon heads to promote the user's progress in playing golf.

With the light metal wood club using this club head, the user can also have a soft feeling at impact and control the curve of the flight line of the ball so that the users familiar with wood clubs with persimmon heads also use the metal wood club with this club head without reluctance, and the soft impact results in little troubles of the user's elbows.

The assembly line for producing the club head is organized with the main member of the core foamed metal as the center to which the shell member is affixed in sequence by means of adhesion, pressure welding, welding, and so on.

Therefore, the production can be rationalized and automated to sharply cut the cost.

The club head has sufficient strength since the main member of the core foamed metal is covered with the shell member made of metal and so on.

DETAILED DESCRIPTION OF THE INVENTION

Figure 1:
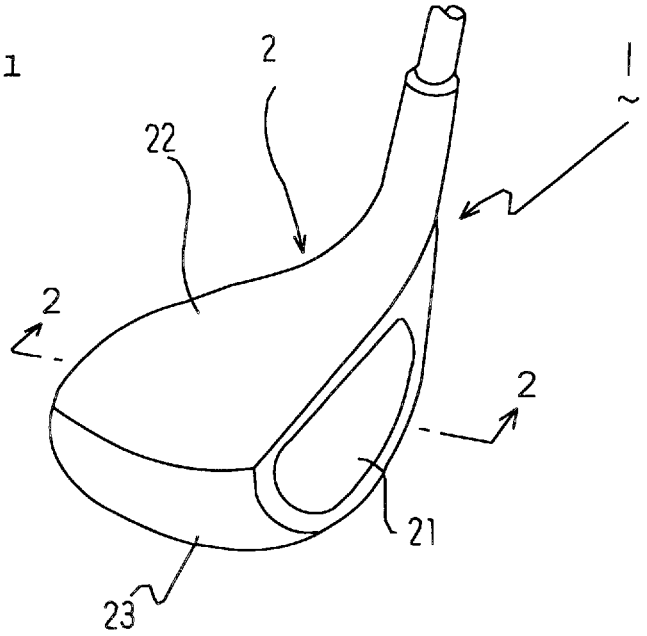
FIG. 1 is an outer view of an embodiment of a metal wood club head for golf relating to the present invention.

Referring to the drawings, preferred embodiments of a metal wood club head for golf and a metal wood golf club with the club head relating to the present invention will be described hereinafter.

Figure 2:
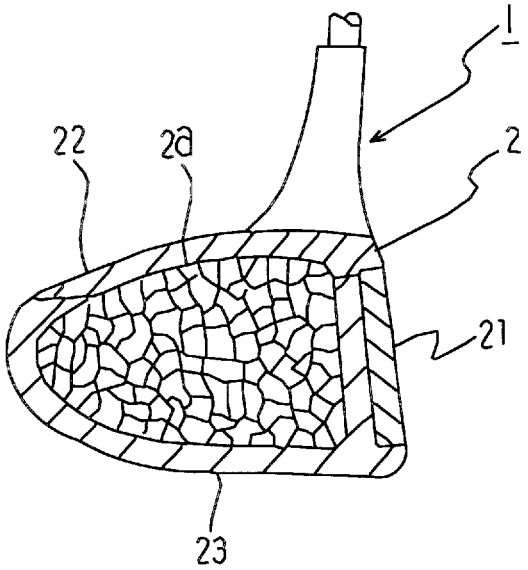
FIG. 2 is a sectional view taken along line A—A of FIG. 1.

FIG. 1 is an outer view showing a first embodiment of a metal wood club head for golf relating to the present invention; FIG. 2 is a sectional view taken along line A—A of FIG. 1.

Metal wood club head for golf 1 comprises metal outer shell 2 with hollow inside portion 2*a* and foamed metal 3 arranged in hollow inside portion 2*a*. In the shown embodiment, face plate 21 is integrally fixed to outer shell 2 assembled by upper portion 22 and sole portion 23, face plate 21 comprising a face insert made of other than by upper portion 22 as a first portion and sole portion 23 as a second portion.

In the present invention, outer shell 2 is not limited to the shown embodiment so that outer shell 2 may comprise upper portion 22 as a first portion and sole portion 23 as a second portion, and face plate 21 which have been integrally molded.

Outer shell 2 is made of metal. There is no limitation for metal materials to be used and any known materials generally used for metal wood club heads may be used. To put it concretely, stainless alloy, aluminum alloy, titanium, titanium alloy and so on can be favorably used.

Among the above mentioned materials, titanium or titanium alloy is more favorably used because of its high strength and superior durability and impact resiliency. To put it more concretely, more preferred embodiment is shown such as Ti-Al alloy, Ni-Ti alloy, Ti-6Al-4V alloy, Ti-4.5Al-3V-2Fe-2Mo alloy, and so on, especially Ti-Al alloy (specific gravity : 3.9) is most favorably used because of its high strength relative to its specific gravity.

The outer shell is molded of the metal materials by casting or press.

Namely upper portion 22, sole portion 23 and face plate 21 are respectively molded by means of lost wax casting then welded together to form the outer shell.

Alternatively cold-rolled plate or coil having the required thickness and structure is formed into required configuration such as upper portion 22, sole portion 23 or face plate 21 by means of cold press or hot press to be assembled by welding.

Outer shell 2 formed as described above has hollow inside portion 2*a* into which foamed metal 3 is arranged.

The foamed metal means light metal composite with superb absorptivity at impact which is porous and has independent or sequential foams dispersed as cells.

For preparing foamed metal, a method can be shown as an example such that particles as foamed agent such as hydride or natural mineral is added to and mixed with molten metal thickened by means of alloying, oxidation, dispersion of ceramic particles and so on. The hydride or natural mineral generates gas at about melting point of the molten metal, then the generated gas is kept in the molten metal. There is another method shown as an example that calcium is added to molten metal to be oxdated and thickened by stirring, and titanium hydride is added to and mixed with the molten metal to keep decomposed hydrogen gas therein.

There is another method to foam metal with a high melting point such as copper, iron and so on, and metal with a low melting point such as aluminum and so on. Gas is solved under atmospheric pressure into molten metal thickened through a method according to the kind of the molten metal by blowing hydrogen, nitrogen, oxygen or mixed gas thereof into the molten metal or dispersing and mixing particles such as hydride, nitride, oxide or mineral with water content which generate gas by thermal decomposition into the molten metal by stirring, then the pressure is reduced to below −400 mmHg to foam the molten metal.

Thus produced foamed metal, for example, foamed aluminum has apparent specific gravity of about 0.2–0.3 and porosity of about 65–78%. The foamed metal is light and has superb absorptivity because the foamed metal is porous and has independent or sequential foams dispersed as cells.

The foamed metal is arranged to fill the whole hollow area inside portion 2*a* of metal outer shell 2 to make outer shell 2 solid without increasing the weight so that capacity of the metal wood club head can be sufficiently secured while the superb absorptivity enables the user to have a soft feeling at impact, to be able to skillfully control the curve of the ball, and to feel where on the club face the ball was hit, and the soft impact results in little trouble to the users' elbows.

Foamed metal 3 is filled into the whole hollow portion 2*a* in assembling outer shell 2. In an embodiment as shown in FIG. 2 foamed metal 3 is filled inside sole portion 23, then upper portion 22 and face plate 21 are respectively affixed thereto by welding and so on.

Foamed metal 3 filled in hollow portion 2*a* and outer shell 2 are welded together by casting.

The present invention may adopt another method such that shell 2 consisting of upper portion 22, sole portion 23 and face portion 21 is integrally molded by casting with foamed metal as the core being filled inside thereof in advance to being casted integrally with the core.

Another method of forming upper portion 22, sole portion 23 and face portion 21 by metal spray on the surface of foamed metal 3 may be adopted.

Alternatively foamed metal 3 may be attached to outer shell 2 with an adhensive agent or may be united integrally with outer shell 2 by means of brazing.

Thus foamed metal 3 filled inside outer shell 2 should be integrated with the outer shell 2 for absorptivity at impact, which is a feature of foamed metal, can be sufficiently fulfilled so that the user can receive a good feeling of a shot to control the ball skillfully, and troubles of elbows can be sufficiently prevented.

Kind of foamed metal 3 is not limited but foamed aluminum is favorably used because of its small specific gravity and its superb absorptivity for impact.

Figure 3:
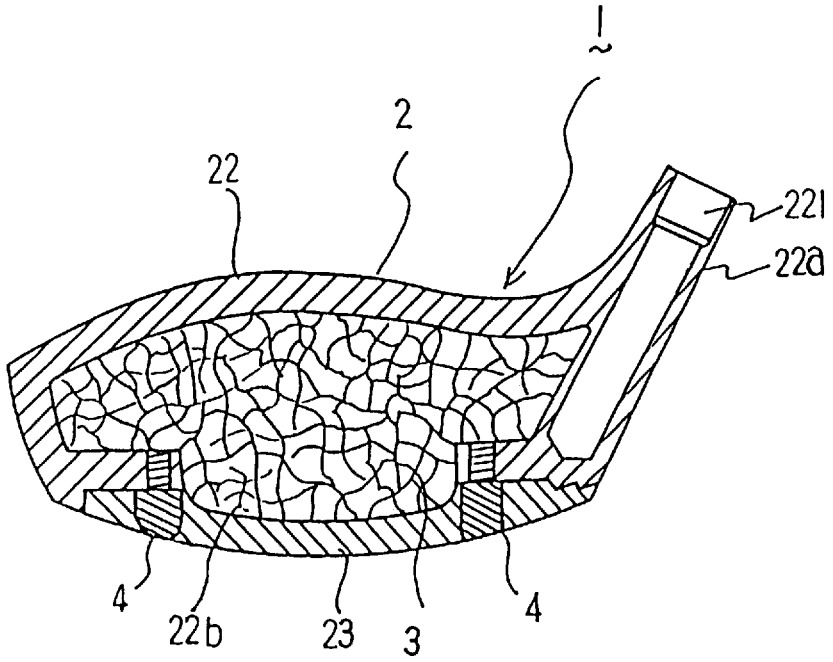
FIG. 3 is a sectional view of another embodiment of a metal wood club head for golf relating to the present invention.

FIG. 3 is a sectional view of another embodiment of metal wood club head 1 relating to the present invention. In this embodiment, outer husk 2 comprises upper main member 22 as a first portion casted integrally with hosel portion 22*a* on the base end portion and sole portion 23 as a second portion. Insert hole 221 is provided through hosel portion 22*a* into which a shaft is inserted and fixed. In the embodiment, outer shell 2 is assembled by fastening upper main member and sole portion 23 with bolts 4.

In the present invention, outer shell 2 having hollow inside portion 2*a* may be assembled by affixing the members by means of welding according to the above mentioned embodiments or fastening the members with bolts, screws, or rivets.

In the embodiment as shown in FIG. 3, aperture 22*b* of upper main member 22 looks upwardly and is closed by fastening of sole portion 23 with bolts to upper main member 22 to assemble outer shell 2 after filling foamed aluminium 3 into inside whole upper main member 22. Then foamed metal 3 is united integrally with outer shell 2 by means of adhesion, welding or brazing.

Figure 4:
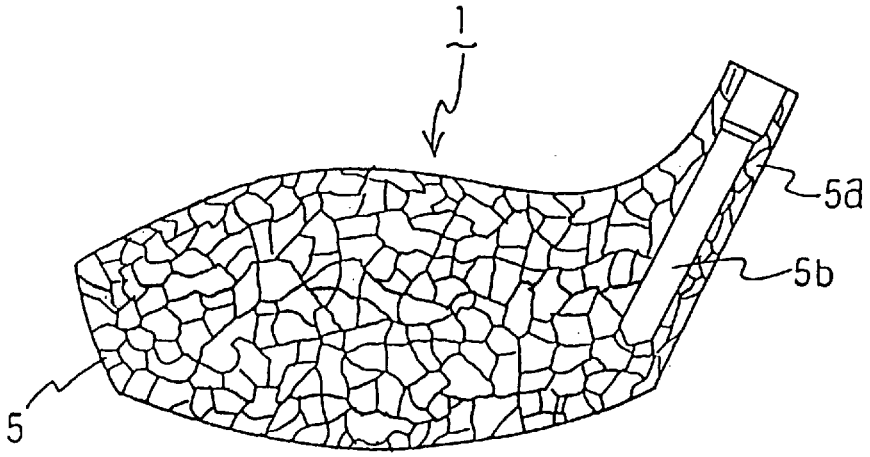
FIG. 4 is a sectional view of another embodiment of a metal wood club head for golf relating to the present invention.

FIG. 4 is a sectional view of another embodiment of metal wood club head 1 relating to the present invention.

In this embodiment, main member 5 of metal wood club head 1 comprises foamed metal, having the base end portion integrated with hosel portion 5*a*. Insert hole 5*b* is provided through hosel portion 5*a* into which a shaft is inserted and fixed.

Figure 5:
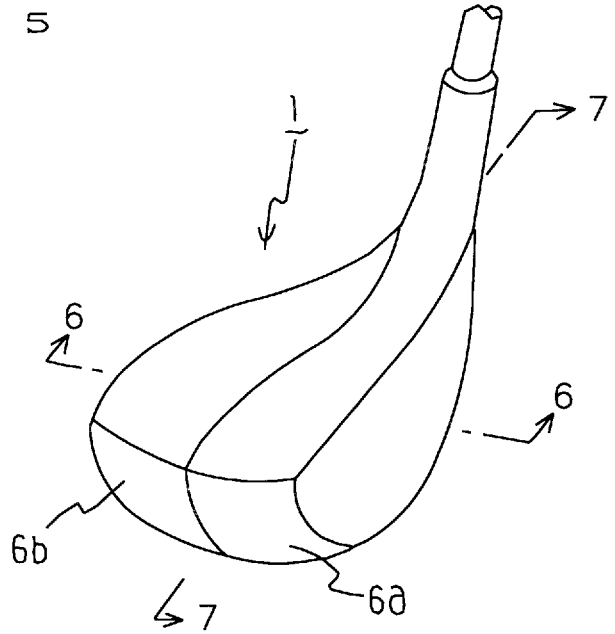
FIG. 5 is an outer view of another embodiment of a metal wood club head for golf relating to the present invention.
Figure 6:
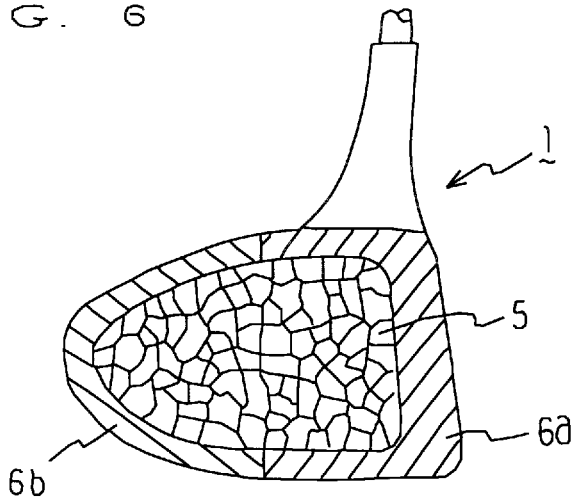
FIG. 6 is a sectional view taken along line A—A of FIG. 5.

FIG. 5 is an outer view of another embodiment of metal wood club head 1 relating to the present invention and FIG. 6 is a sectional view taken along line A—A of FIG. 5.

In this embodiment, metal wood club head 1 comprises main member 5 of foamed metal and shell member divided into two pieces 6*a* as a first portion, 6*b* as a second portion. Fixed onto the surface of main member 5.

Figure 7:
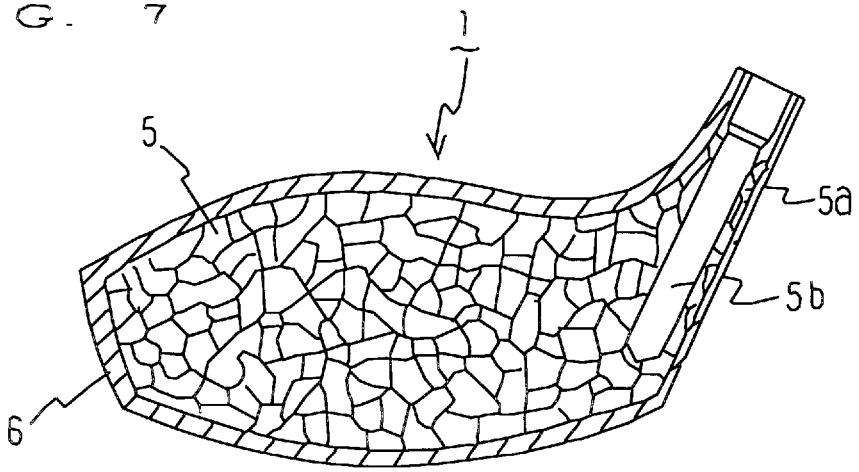
FIG. 7 is a sectional view taken along line B—B of FIG. 5.

FIG. 7 is a sectional view taken along line B—B.

In the embodiment, main member 5 is integrated with hosel portion 5*a* at the base end portion in casting. Shaft insert hole 5*b* is provided through hosel portion 5*a* into which a shaft is inserted and fixed. Main member 5 and shell member 6 are united integrally by means of adhesion, welding or pressure welding.

Alternatively the present invention may adopt a method for forming shell member 6 by metal spray onto the surface of main member 5.

Main member 5 comprises foamed metal. For preparing main member 5, thickned molten metal produced in process of preparation of foamed metal as described above to which hydrogen gas and so on is solved is casted into a mold and cooled to be taken out of the mold after reduction of the pressure below—400 mmHg so that main member 5 of required configuration can be provided.

Shell member 6 comprises metal materials. There is no limitation of the metal materials to be used and any known materials generally used for metal wood club heads may be used. To put it concretely, stainless alloy, aluminum alloy, titanium, titanium alloy and so on can be favorably used.

Among the above mentioned materials, titanium or titanium alloy is more favorably used because of its high strength and superior durability and impact resiliency. To put it more concretely, a more preferred embodiment is shown such as Ti-Al alloy, Ni-Ti alloy, Ti-6Al-4V alloy, Ti-4.5Al-3V-2Fe-2Mo alloy, and so on, especially Ti-Al alloy (specific gravity : 3.9) is most favorably used because of its high strength relative to its specific gravity.

Figure 8:
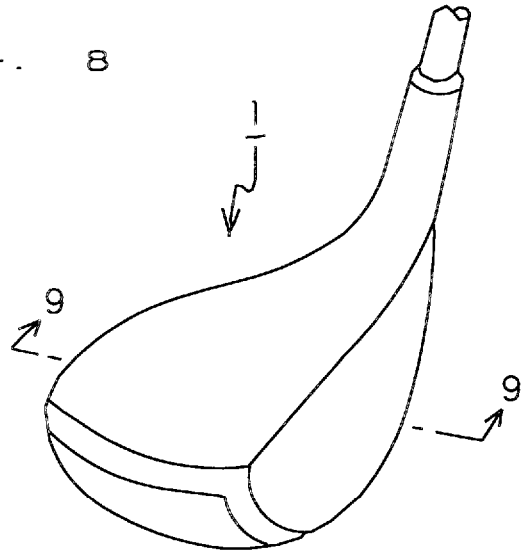
FIG. 8 is an outer view of another embodiment of a metal wood club head for golf relating to the present invention.
Figure 9:
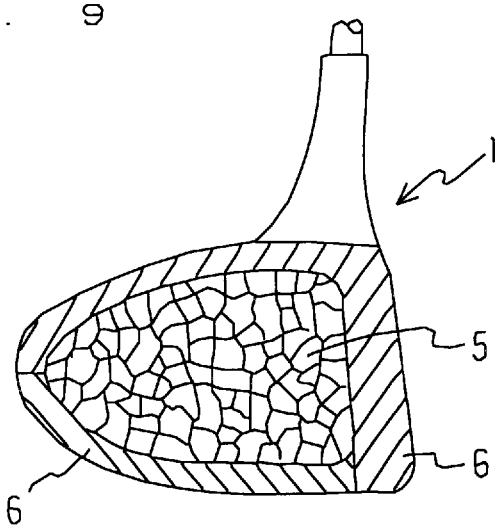
FIG. 9 is a sectional view taken along line A—A of FIG. 8.
Figure 10:
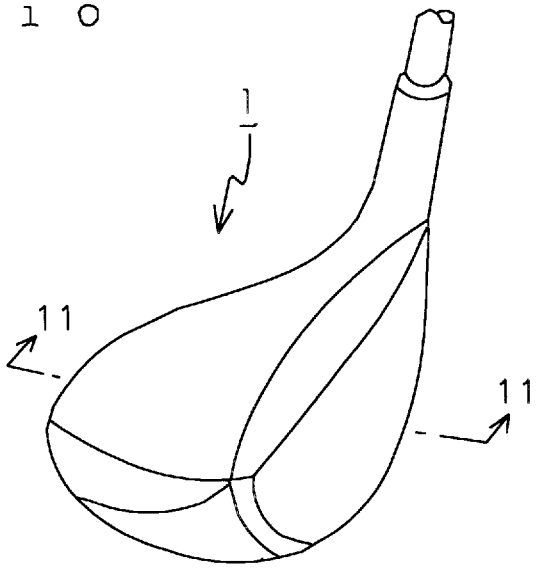
FIG. 10 is an outer view of another embodiment of a metal wood club head for golf relating to the present invention.
Figure 11:
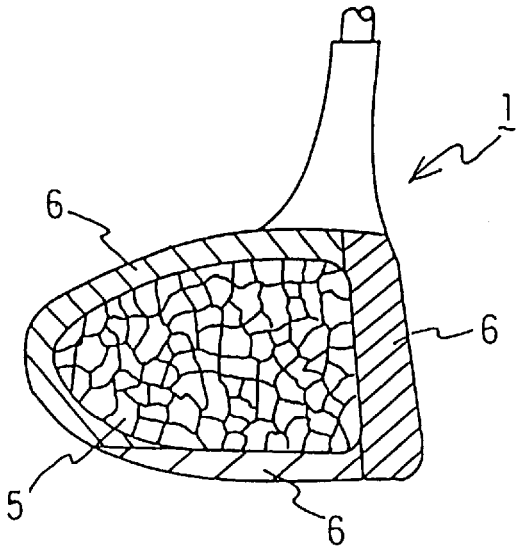
FIG. 11 is a sectional view taken along line A—A of FIG. 10.

In the embodiment as shown in FIG. 5, shell member 6 comprises piece 6*a* with a face plate and piece 6*b* without a face plate. In the present invention, however, there is no limitation for a method to divide shell member 6. Shell member 6 may be divided into any suitable pieces, for example, into pieces as shown in FIG. 8 or into three pieces as shown in FIG. 10. (FIGS. 9 and 11 respectively show sectional views taken line A—A of FIGS. 8 and 10.) Different materials can be respectively used for pieces of shell member 6. For example, face plate is made of titanium alloy and the other piece or pieces are made of duralumin. Shell member 6 is generally molded by means of casting or press. To put it concretely, shell member 6 is molded as required configuration for example by lost wax casting, or cold press or hot press of cold rolled plate or coil having required thickness and construction.

If Ti-Al alloy is used, there is another example of molding that Ti powder and Al-Mn powder are mixed and preliminarily molded by compression to be heated again under high pressure for fixation of the configuration.

Main member 5 and shell member 6 molded by the above mentioned methods are integrated by affixing shell member 6 on the surface of main member 5 comprising foamed metal by means of adhesion, welding, pressure welding and so on. Since the methods can be used, a metal wood club head relating to the present invention can be produced with the shell member made of some kinds of metal without confronting the problem that certain kinds of metal can not be welded to each other.

Alternatively, the invention may adopt a method that shell member 6 is molded by metal spray on the surface of main member 5.

The assembly line for producing the club head is organized with the main member of core foamed metal as the center to which the shell member is fixed in sequence by robots, therefore the production can be rationalized and automated to sharply cut the cost.

The kind of the foamed metal is not limited but foamed aluminum is favorably used because of its small specific gravity and its superb absorptivity at impact.

There is not a limitation for an adhesive which may be used as means for affixing the shell member on the surface of the foamed metal, but silicon adhesive, for example "KE3417" produced by Shinetsu Silicon K. K., can be favorably used.

I claim:

1. A metal wood golf club head comprising:

a metal outer shell; and a foamed aluminum inside portion having a sequence of cells distributed throughout the entirety of said foamed aluinum inside portion and having an apparent specific gravity of about 0.2–0.3 and porosity of about 65–78%, and fixedly attached within the metal outer shell and formed integrally with said metal outer shell.

2. The metal golf club head recited in claim 1 wherein the majority of the golf club head by volume is foamed aluminum.

3. The metal golf club head of claim 2 and further comprising a face plate in contact with said metal shell, wherein said at least a surface of the face plate is covered with metal.

4. A metal golf club head comprising:

a divided metal outer shell having a first portion including a hollowed area and matable with a second portion having a hollowed area to completely surround and enclose said hollowed areas; and a foamed aluminum inside portion having a sequence of cells distributed throughout the entirety of said foamed aluminum inside portion and having an apparent specific gravity of about 0.2–0.3 and a porosity of about 65–78% and fixedly carried within said hollowed area.

5. The metal golf club head as recited in claim 4 wherein said first and second portion of said divided metal outer shell is a cast metal.

6. The metal golf club head as recited in claim 5 wherein said upper main member and said sole portion of said divided metal outer shell are press metal.

* * * * *